US010370827B2

(12) United States Patent
Koga

(10) Patent No.: US 10,370,827 B2
(45) Date of Patent: Aug. 6, 2019

(54) EXCAVATOR MANAGING DEVICE AND SUPPORT DEVICE

(71) Applicant: SUMITOMO HEAVY INDUSTRIES, LTD., Tokyo (JP)

(72) Inventor: Masato Koga, Kanagawa (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 0 days.

(21) Appl. No.: 15/215,298

(22) Filed: Jul. 20, 2016

(65) Prior Publication Data

US 2016/0326726 A1 Nov. 10, 2016

Related U.S. Application Data

(63) Continuation of application No. PCT/JP2015/051079, filed on Jan. 16, 2015.

(30) Foreign Application Priority Data

Jan. 21, 2014 (JP) ..... 2014-008518

(51) Int. Cl.

| | |
|---|---|
| ***E02F 9/26*** | (2006.01) |
| ***E02F 3/30*** | (2006.01) |
| ***G07C 5/00*** | (2006.01) |
| ***G07C 5/08*** | (2006.01) |
| ***E02F 9/20*** | (2006.01) |

(52) U.S. Cl.

CPC ..... *E02F 9/267* (2013.01); *E02F 3/301* (2013.01); *E02F 9/2054* (2013.01); *G07C 5/008* (2013.01); *G07C 5/085* (2013.01); *G07C 5/0825* (2013.01); *G07C 5/0841* (2013.01); *G07C 5/0816* (2013.01)

(58) Field of Classification Search

CPC ..... E02F 9/267; E02F 3/301; E02F 9/2054; G07C 5/008; G07C 5/0825; G07C 5/0841

See application file for complete search history.

(56) References Cited

U.S. PATENT DOCUMENTS

| | | | | |
|---|---|---|---|---|
| 9,886,803 | B2 * | 2/2018 | Oswald | B66C 13/18 |
| 2011/0227744 | A1 * | 9/2011 | Shibata | G05B 23/0272 340/679 |

(Continued)

FOREIGN PATENT DOCUMENTS

| | | | |
|---|---|---|---|
| JP | 2007-224531 | A | 9/2007 |
| JP | 2013-235485 | A | 11/2013 |

(Continued)

*Primary Examiner* — Todd M Melton

(74) *Attorney, Agent, or Firm* — IPUSA, PLLC

(57) ABSTRACT

An excavator managing device has a communication device, a storage device, and a processing device. The processing device receives machine identification information of an excavator and operation information representing the operation status of the excavator from the excavator through the communication device. In addition, machine identification information of an excavator and failure classification information of the excavator are received from a support device through the communication device. Thereafter, the failure classification information and the operation information are stored in the storage device in association with each other. With the excavator managing device having this configuration, past repair experience can be easily applied to future repair operations.

16 Claims, 22 Drawing Sheets

(56) References Cited

U.S. PATENT DOCUMENTS

| | | | | |
|---|---|---|---|---|
| 2012/0116631 | A1* | 5/2012 | Lee | G06Q 10/0639 701/32.1 |
| 2014/0236418 | A1 | 8/2014 | Koga et al. | |
| 2015/0161969 | A1* | 6/2015 | Zaizen | G07C 5/008 345/629 |

FOREIGN PATENT DOCUMENTS

| | | | |
|---|---|---|---|
| WO | WO-2013/047408 | A1 | 4/2013 |
| WO | WO-2013/168657 | A1 | 11/2013 |

* cited by examiner

| OPERATION INFORMATION | | | | | | |
|---|---|---|---|---|---|---|
| MACHINE ID. INFO. | DATE | OPERATING TIME | PUMP PRESSURE | HYDRAULIC LOAD | ATTENDED TIME | ・・・ |
| A001 | 2013/05/10 | a1 | b1 | c1 | d1 | ・・・ |
| A001 | 2013/05/11 | a2 | b2 | c2 | d2 | ・・・ |
| A002 | 2013/05/07 | a3 | b3 | c3 | d3 | ・・・ |

Fig.3A

| FAILURE CLASSIFICATION INFORMATION | | |
|---|---|---|
| MACHINE ID. INFO. | DATE | FAILURE CLASSIFICATION |
| A001 | 2013/02/01 | FAN BREAKAGE |
| A001 | 2013/09/14 | ENGINE INJECTOR ABNORMALITY |
| A002 | 2013/01/21 | SWIVELING MOTOR ABNORMALITY |
| | | |

Fig.3B

| FAILURE COUNTERMEASURE INFORMATION | | |
|---|---|---|
| MACHINE ID. INFO. | DATE | FAILURE COUNTERMEASURE |
| A001 | 2013/02/01 | FAN REPLACEMENT |
| A001 | 2013/09/14 | ENGINE INJECTOR REPAIR |
| A002 | 2013/01/21 | SWIVELING MOTOR REPLACEMENT |
| | | |

Fig.3C

| DISPOSITION INFORMATION | |
|---|---|
| MACHINE ID. INFO. | CURRENT POSITION |
| A001 | xx°yy'zz" EAST LONGITUDE aa°bb'cc" NORTH LATITUDE |
| A002 | xx°yy'zz" EAST LONGITUDE aa°bb'cc" NORTH LATITUDE |
| A003 | xx°yy'zz" EAST LONGITUDE aa°bb'cc" NORTH LATITUDE |
| | |

Fig.11B MACHINE ID. INFO. RECEPTION
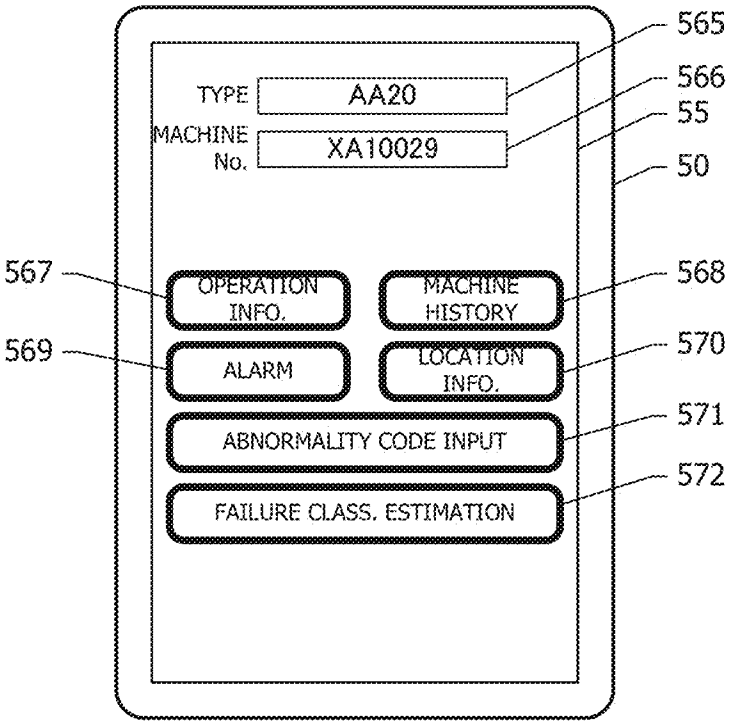
Fig.11A INITIAL SCREEN
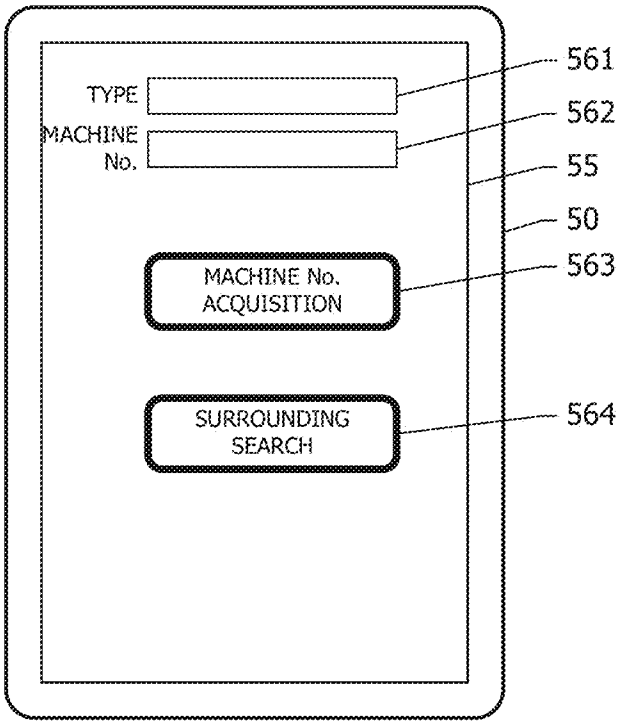

Fig.11C ABNORMALITY CODE INPUT
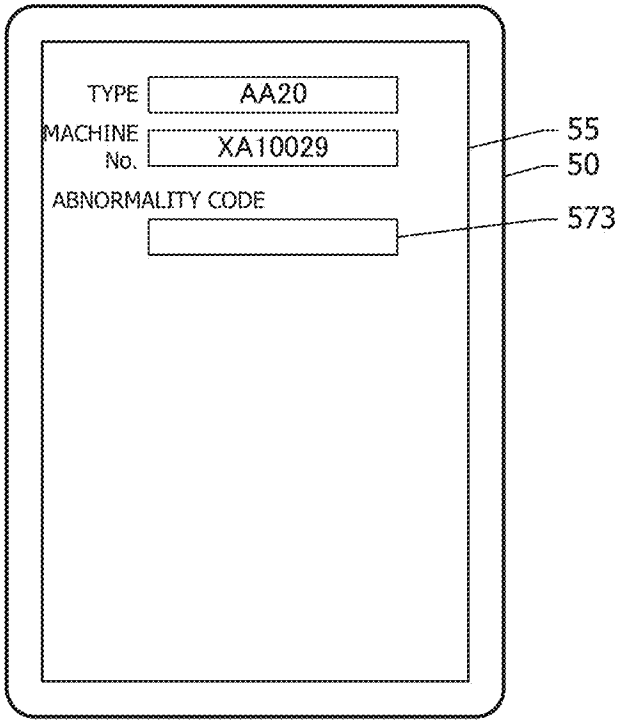
Fig.11D FAILURE SEARCH SUPPORT INFO. DISPLAY
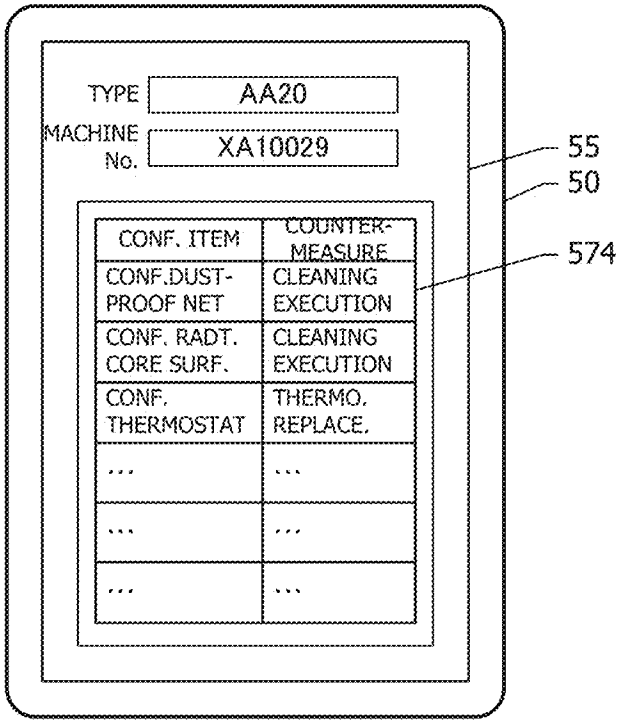

Fig.11E FAILURE CLASSIFICATION INPUT SCREEN
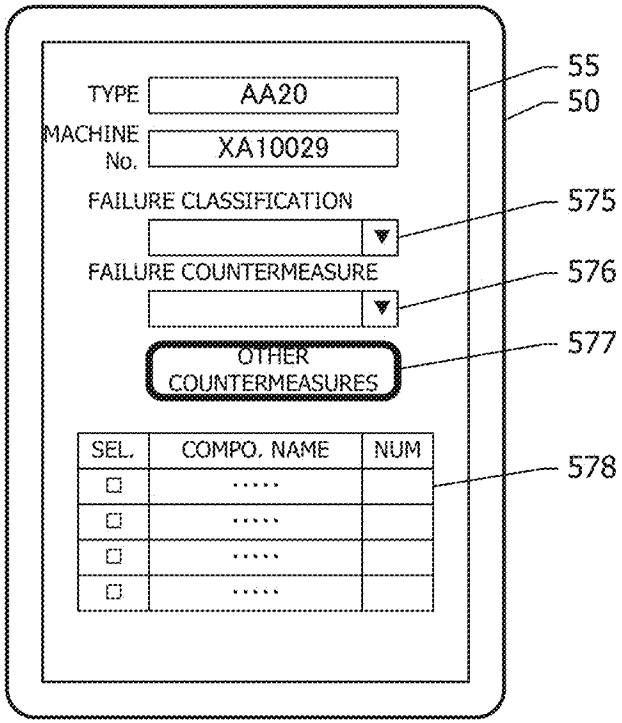
Fig.11F FAILURE CLASSIFICATION INPUT SCREEN
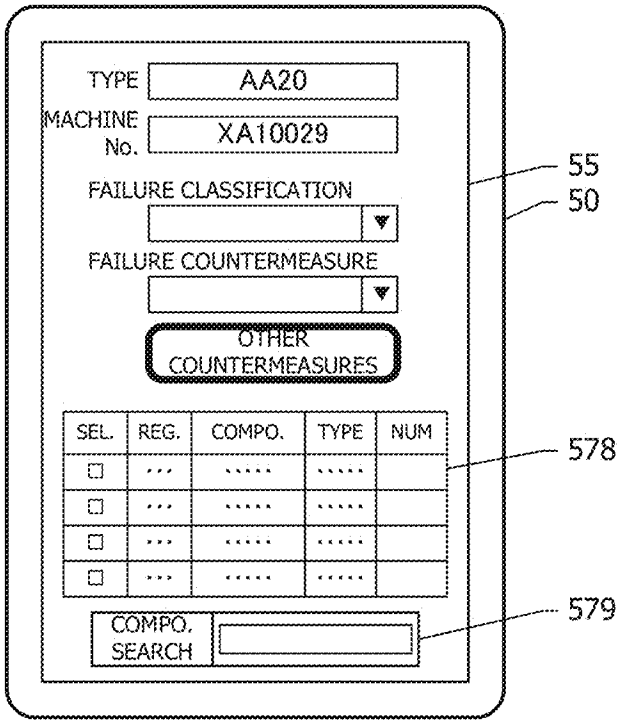

Fig.12B ONE EXCAVATOR SELECTION
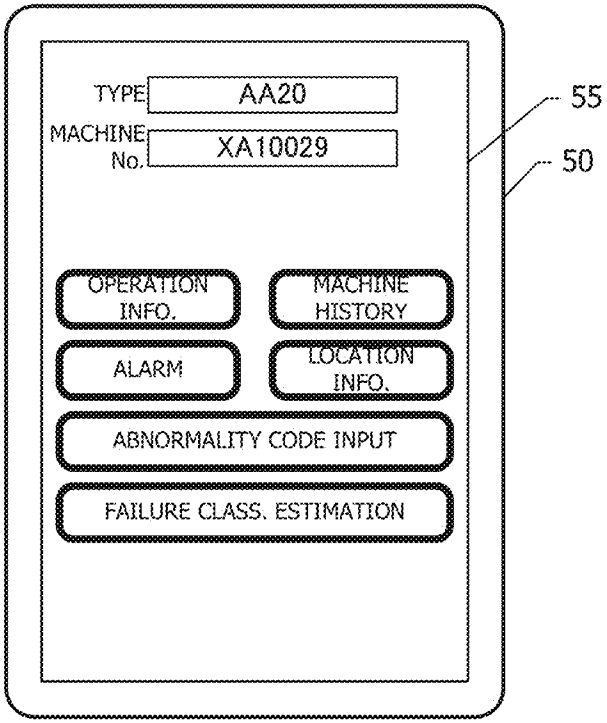
Fig.12A SURROUNDING SEARCH
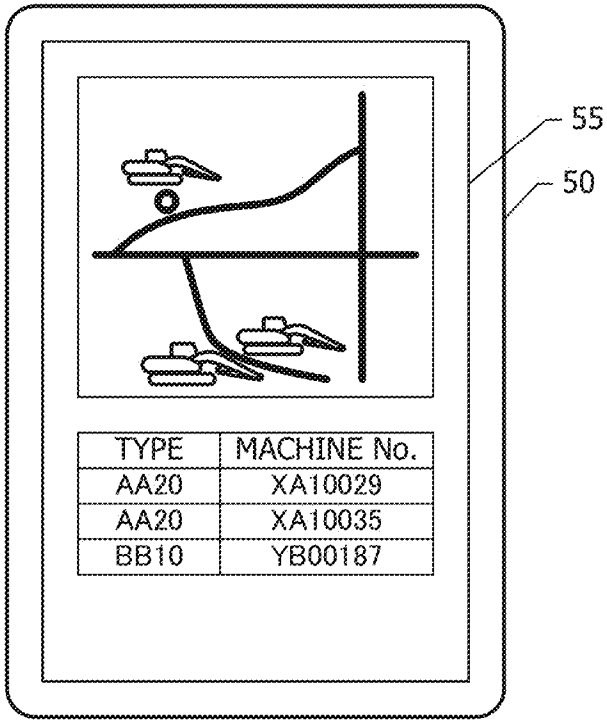

FAILURE CLASSIFICATION ESTIMATION RESULT DISPLAY

| PRIO RITY | PROB | FAILURE CLASS. |
|---|---|---|
| 1 | 50% | ENGINE INJECTOR ABN. |
| 2 | 10% | ENGINE OIL COOLER ABN. |
| 3 | 5% | ENGINE ALTERN. ABN. |
| 4 | 3% | SWIVELING MOTOR ABN. |

55

50

Fig.14A FAILURE SEARCH SUPPORT INFO. DISPLAY
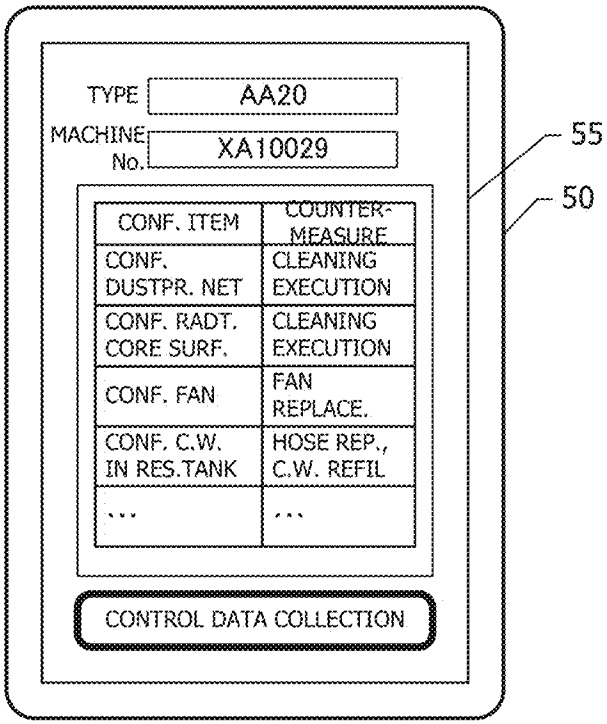
Fig.14B CONTROL DATA DISPLAY
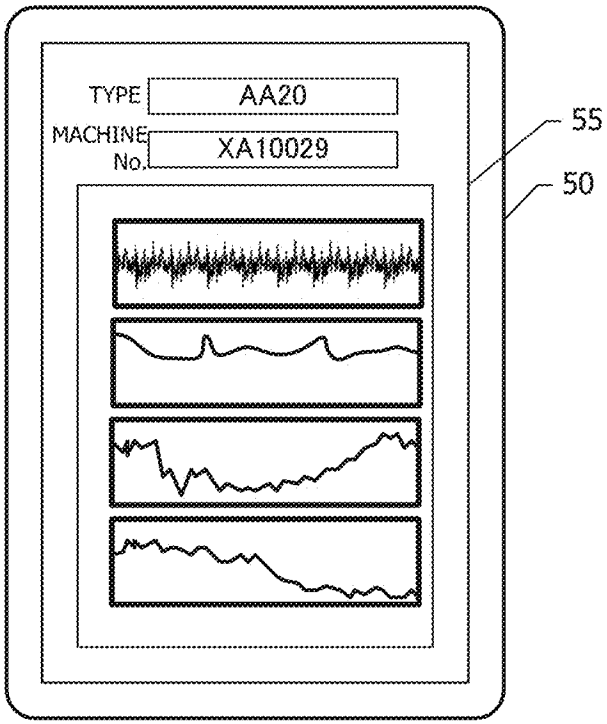

EXCAVATOR MANAGING DEVICE AND SUPPORT DEVICE

RELATED APPLICATION

This is a Continuation of International Patent Application No. PCT/JP2015/051079 filed Jan. 16, 2015, which claims priority from Japanese Patent Application No. 2014-8518 filed Jan. 21, 2014. The contents of these applications are incorporated herein by reference.

BACKGROUND

Technical Field

The present invention relates to an excavator managing device and a support device which supports maintenance of an excavator.

Description of Related Art

A failure diagnosis device for a working machine which determines what kind of abnormality is generated in an excavator based on signals acquired by various sensors mounted in the excavator and displays an abnormality code and the content of the abnormality is known. In this failure diagnosis device, while the content of an abnormality that a value detected by a sensor is abnormal is displayed, information regarding what component has failed and what countermeasure should be taken is not specifically provided.

An excavator managing device which estimates a suspected component estimated that failure is generated based on operation information of an excavator, or the like and displays an estimation result is known.

In general, a serviceman searches for a failure point with reference to a troubleshooting manual or the like prepared for each abnormality code. In a case where the serviceman specifies the failure point and performs a repair, in the related art, a repair content is recorded on a paper medium.

SUMMARY

According to an aspect of the invention, there is provided an excavator managing device including a communication device, a storage device, and a processing device. The processing device receives machine identification information of an excavator and operation information representing the operation status of the excavator from the excavator through the communication device, receives machine identification information of the excavator and failure classification information of the excavator from a support device through the communication device, and stores the failure classification information and the operation information in the storage device in association with each other.

According to another aspect of the invention, there is provided a support device including a display device, an input device, a communication device, and a processing device. If failure search support information for specifying a failure classification of the excavator is received from the managing device through the communication device, the processing device displays the received failure search support information on the display device, and if a failure classification generated in an excavator is input from the input device, the processing device transmits the failure classification to a managing device through the communication device.

BRIEF DESCRIPTION OF THE DRAWINGS

FIG. 3A is a chart showing an example of failure classification information, FIG. 3B is a chart showing an example of failure countermeasure information, and FIG. 3C is a chart showing an example of disposition information.

FIG. 11A is a diagram showing an initial screen of the support device, and FIG. 11B is a diagram showing a screen of the support device to which machine identification information is input.

FIG. 11C is a diagram showing an abnormality code input screen of the support device, and FIG. 11D is a diagram showing a screen of the support device on which failure search support information is displayed.

FIGS. 11E and 11F are diagrams showing a failure classification input screen of the support device.

FIG. 12A is a diagram showing a screen of the support device when surrounding search is performed, and FIG. 12B is a diagram showing a screen of the support device when one excavator is selected.

FIG. 14A is a diagram showing a screen of the support device on which failure search support information is displayed, and FIG. 14B is a diagram showing a screen of the support device on which control data received from an excavator is displayed.

DETAILED DESCRIPTION

Information in which an abnormality generated in the excavator is associated with the actual repair content is stored in the paper medium. For this reason, it is difficult to apply the actual repair experience to future repair operations. It is desirable to provide an excavator managing device capable of easily applying past repair experience to future repair operations. Further, it is desirable to provide a support device which communicates with the excavator managing device.

Figure 1:
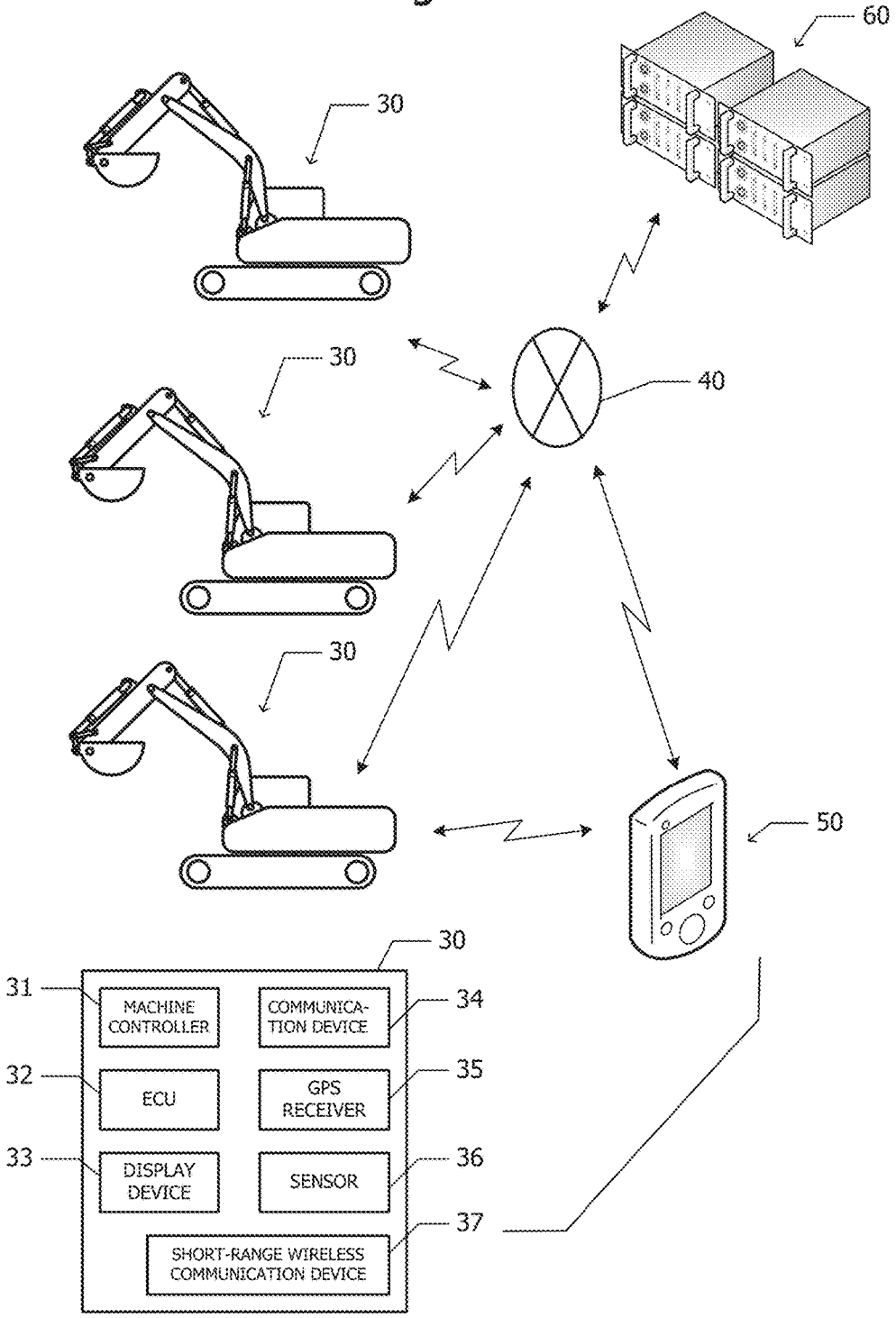
FIG. 1 is a schematic view of a managing system including an excavator managing device and a support device according to an embodiment, and excavators to be managed.

FIG. 1 is a schematic view of a managing system including an excavator managing device 60 and a support device 50 according to an embodiment, and excavators 30 to be managed. The excavators 30, the managing device 60, and the support device 50 perform communication with one another through a network 40. The excavators 30 and the support device 50 may perform direct communication without passing through the network as described below.

In the excavators 30, a machine controller 31, an electronic control unit (ECU) 32, a display device 33, a communication device 34, a global positioning system (GPS) receiver 35, various sensors 36, a short-range wireless communication device 37, and the like are respectively mounted.

The sensors 36 measure various operating variables of the excavator 30. The measured values of the sensors 36 are input to the machine controller 31. The operating variables include, for example, an operating time, a hydraulic pump pressure, a cooling water temperature, a hydraulic load, an attended time, and the like. The machine controller 31 transmits machine identification information of the excavator, the measured values of various operating variables, and current position information calculated by the GPS receiver 35 from the communication device 34 to the managing device 60 through the network 40. The machine controller 31 displays various kinds of information relating to the excavator on the display device 33. The ECU 32 controls an engine based on a command from the machine controller 31. The short-range wireless communication device 37 performs communication with the support device 50 positioned at a short distance. For the short-range wireless communication standard, for example, Bluetooth, wireless LAN, or the like is used. For the support device 50, for example, a mobile phone terminal, a tablet terminal, or the like is used.

The definitions of the terms used in this specification and a specific example will be described referring to FIGS. 2A to 2D and FIGS. 3A to 3C.

Figures 2A, 2B:
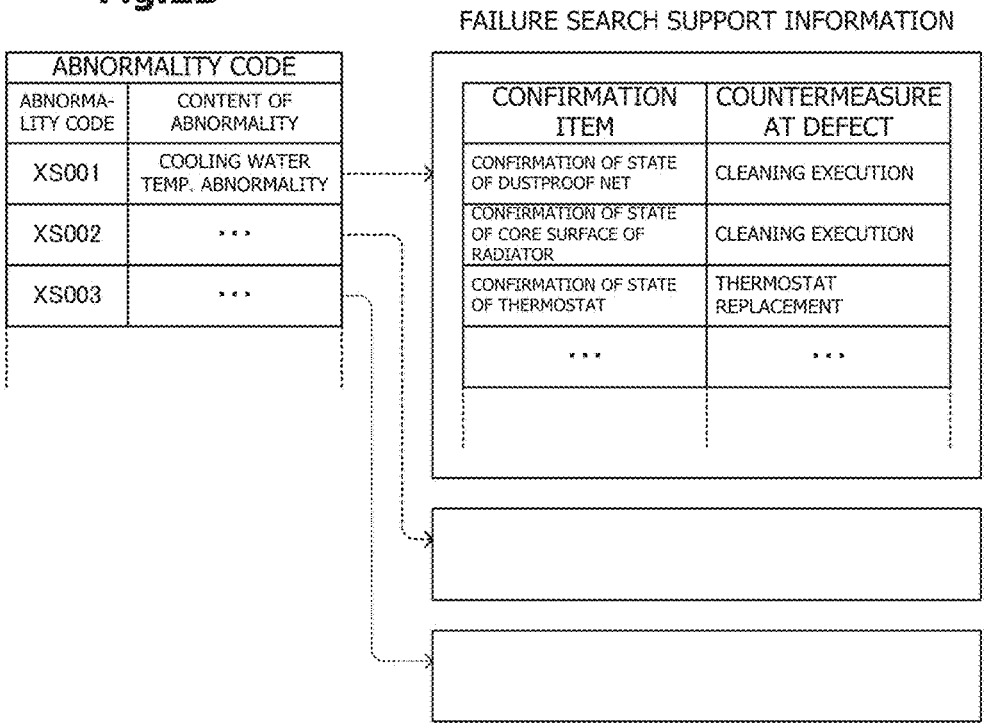
FIG. 2A is a chart showing an example of operation information.
FIG. 2B is a chart showing an example of abnormality codes and failure search support information.

FIG. 2A shows an example of operation information. The operation information is a set of numerical values obtained by measuring the operating variables of the excavator over a determined collection period and performing statistical processing to the measured values. The operation information represents the operation status of the excavator. The operating variables include, for example, "operating time", "pump pressure", "hydraulic load", "operation time", "engine speed", "cooling water temperature", and the like. These values are associated with a machine identification number and date on which data is collected. The "operating time" means the time from when a start switch of the excavator is pressed until a stop switch is pressed, that is, the time for which the excavator is activated. The "attended time" means the time for which an operator operates the excavator. In the example shown in FIG. 2A, the operating time is a1, the pump pressure is b1, the hydraulic load is c1, and the attended time is d1, and all of these are obtained by performing statistical processing on various kinds of data acquired from a machine of machine identification information A001 on May 10, 2013.

FIG. 2B shows an example of an abnormality code and failure search support information. The abnormality code is a code for recognizing an abnormal phenomenon generated in the excavator. In the example shown in FIG. 2B, an abnormality code XS001 is assigned to the content of an abnormality that a cooling water temperature is abnormal. The failure search support information is information for supporting to search for the content of failure from the abnormal phenomenon generated in the excavator. The failure search support information is prepared in association with an abnormality code. One piece of data of the failure search support information includes two items of "confirmation item" and "countermeasure at defect". As an example, the failure search support information associated with the abnormality code corresponding to a cooling water temperature abnormality includes, as the items of the confirmation item, the contents of "confirmation of state of dustproof net", "confirmation of core surface of radiator", and the like, and includes, as the items of the countermeasure at defect, the contents of "cleaning execution" and the like.

FIG. 3A shows an example of failure classification information. One pieces of data of the failure classification information has three items of "machine identification information", "date", and "failure classification". The "failure classification" is information for identifying the content of failure generated in the excavator.

FIG. 3B shows an example of failure countermeasure information. One piece of data of the failure countermeasure information has three items of "machine identification information", "date", and "failure countermeasure". The "failure countermeasure" is information for identifying the content of correcting action performed to repair failure.

Hereinafter, a case where an abnormality is generated in the cooling water temperature will be described in connection with a specific example. One abnormality code XS001 (FIG. 2B) is assigned to an abnormality that is a "cooling water temperature abnormality". The failure search support information associated with the abnormality code XS001 of the "cooling water temperature abnormality" includes information to be a clue for performing a failure search, such as "confirmation of state of dustproof net", "confirmation of state of core surface of radiator", "confirmation of state of fan", and "confirmation of cooling water amount in a reserve tank.

A serviceman performs a failure search with reference to the failure search support information. As a result of the failure search, for example, fan breakage may be found. In this case, in the item "failure classification" of the failure classification information, the content of "fan breakage" is set. If fan breakage is found, the serviceman replaces the fan. In this case, in the item "failure countermeasure" of the failure countermeasure information, the content of "fan replacement" is set.

FIG. 3C shows an example of disposition information. The disposition information has two items of "machine identification information" and "current position". In the item "current position", current position information of the excavator determined from reception data of the GPS receiver 35 (FIG. 1) is set. The current position is represented by, for example, latitude and longitude.

Figure 4:
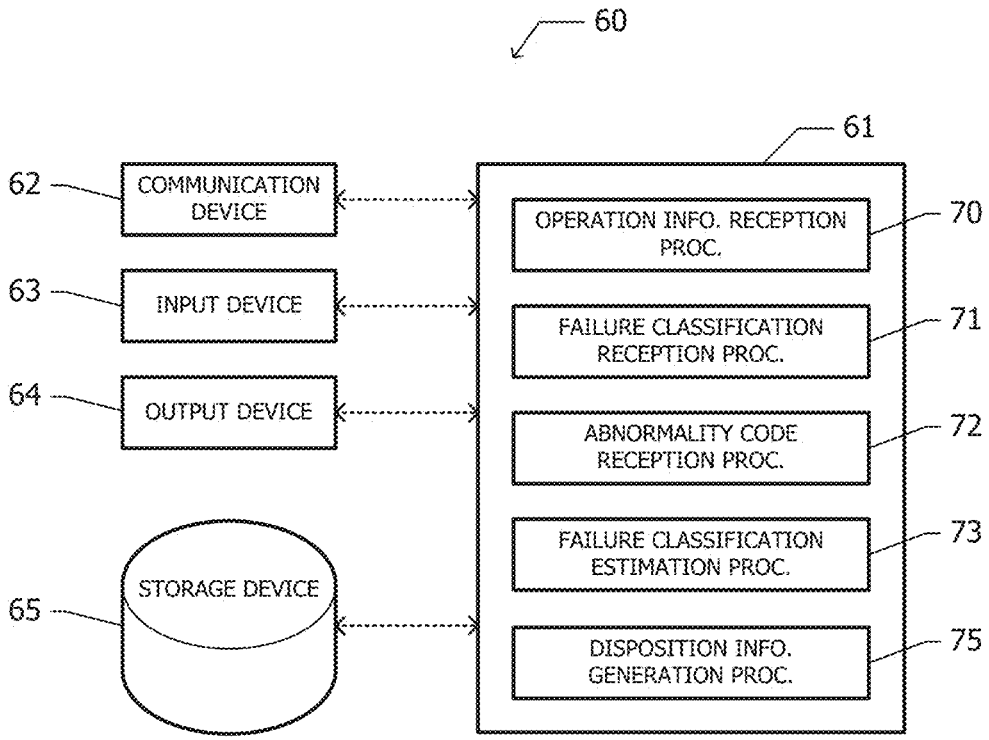
FIG. 4 is a block diagram of the excavator managing device.

FIG. 4 is a block diagram of the excavator managing device 60. The managing device 60 includes a processing device 61, a communication device 62, an input device 63, an output device 64, and a storage device 65. The processing device 61 includes an operation information reception processing unit 70, a failure classification reception processing unit 71, an abnormality code reception processing unit 72, a failure classification estimation processing unit 73, and a disposition information generation processing unit 75. The functions of these processing units are realized by executing a computer program.

The operation information reception processing unit 70 receives operation information (FIG. 2A) from a plurality of excavators 30 at regular intervals and stores the operation information in the storage device 65. Basic data before performing statistical processing on various kinds of data may be received from each of the excavators 30, and the operation information reception processing unit 70 may perform statistic processing on received basic data to generate operation information.

Figure 5:
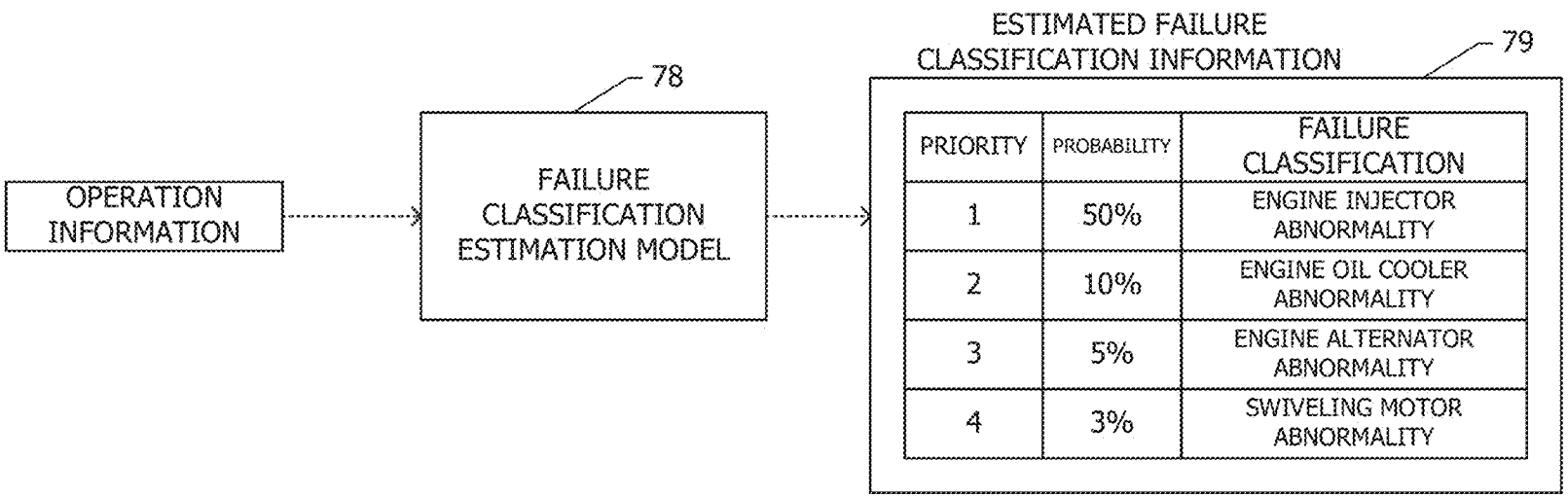
FIG. 5 is a chart showing an example of estimated failure classification information estimated using a failure classification estimation model.

The function of the failure classification estimation processing unit 73 will be described referring to FIG. 5. The failure classification estimation processing unit 73 applies a failure classification estimation model 78 to operation information collected from the excavator 30 to generate estimated failure classification information 79 when any abnormality is generated in the excavator 30 (FIG. 1).

One piece of data of the estimated failure classification information 79 includes three items of priority, probability, and failure classification. The item "failure classification" represents a failure classification estimated to be generated in the excavator. The item "probability" represents a probability that failure corresponding to the failure classification is generated. The item "priority" represents a descending order of the probability. In the example shown in FIG. 5, a probability that an "engine injector abnormality" occurs is 50%, a probability that an "engine oil cooler abnormality" occurs is 10%, a probability that an "engine alternator abnormality" occurs is 5%, and a probability that a "swiveling motor abnormality" occurs is 3%. As an estimation method of the failure classification and the probability, for example, a method disclosed in International Publication No. WO2013/047408 can be applied.

The functions of other processing units of the processing device 61 shown in FIG. 4 will be described referring to FIGS. 7 to 10.

Figure 6:
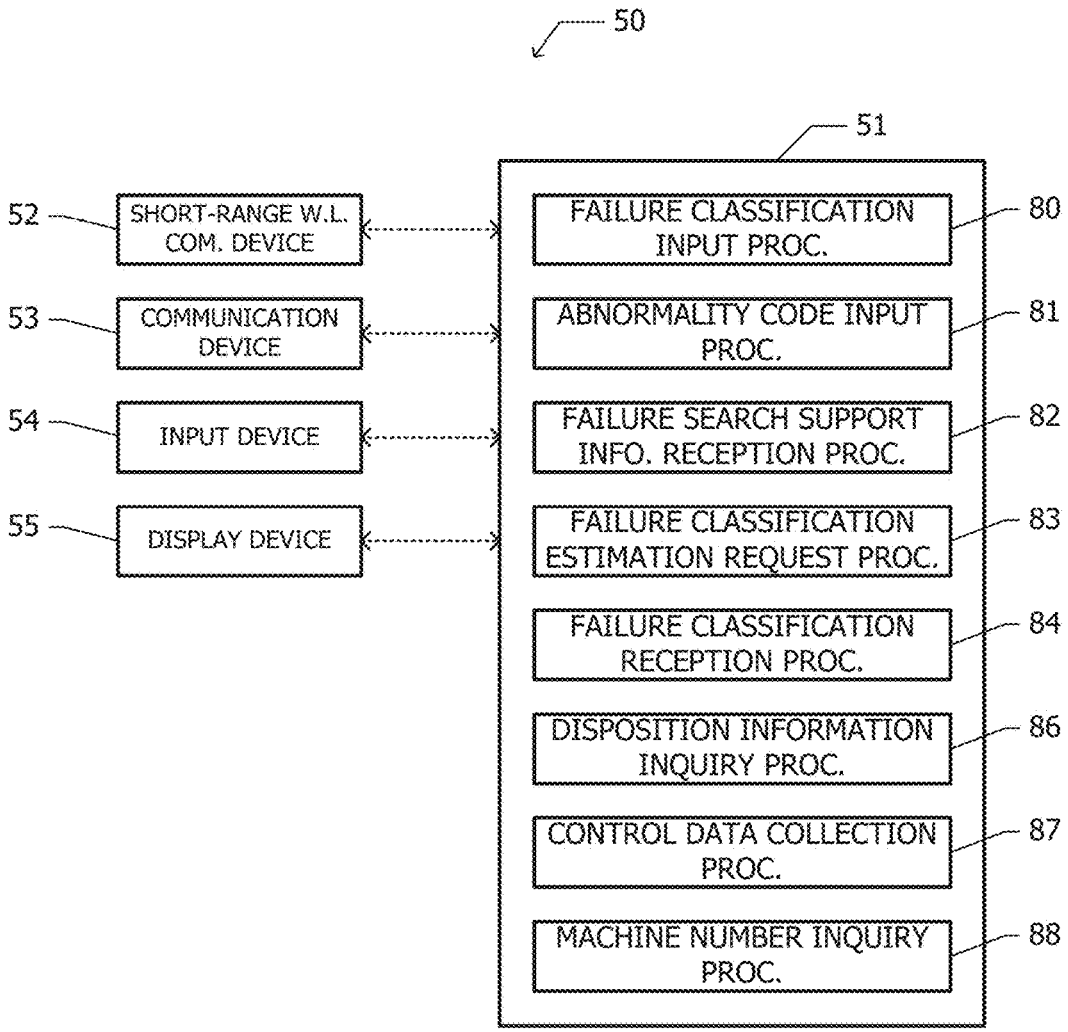
FIG. 6 is a block diagram of the support device for an excavator.

FIG. 6 is a block diagram of the excavator support device 50. The support device 50 includes a processing device 51, a short-range wireless communication device 52, a communication device 53, an input device 54, and a display device 55. As an example, a touch panel doubles as the input device 54 and the display device 55. The short-range wireless communication device 52 performs direct wireless communication with the nearby excavator 30 (FIG. 1). The communication device 53 performs communication with the managing device 60 (FIG. 1) through the network 40.

The processing device 51 includes a failure classification input processing unit 80, an abnormality code input processing unit 81, a failure search support information reception processing unit 82, a failure classification estimation request processing unit 83, a failure classification reception processing unit 84, a disposition information inquiry processing unit 86, a control data collection processing unit 87, and a machine number inquiry processing unit 88. The functions of these processing units are realized by executing a computer program.

The operations of the excavator managing device 60 (FIG. 1) and the support device 50 (FIG. 1) will be described referring to FIGS. 7 to 14B.

Figure 7:
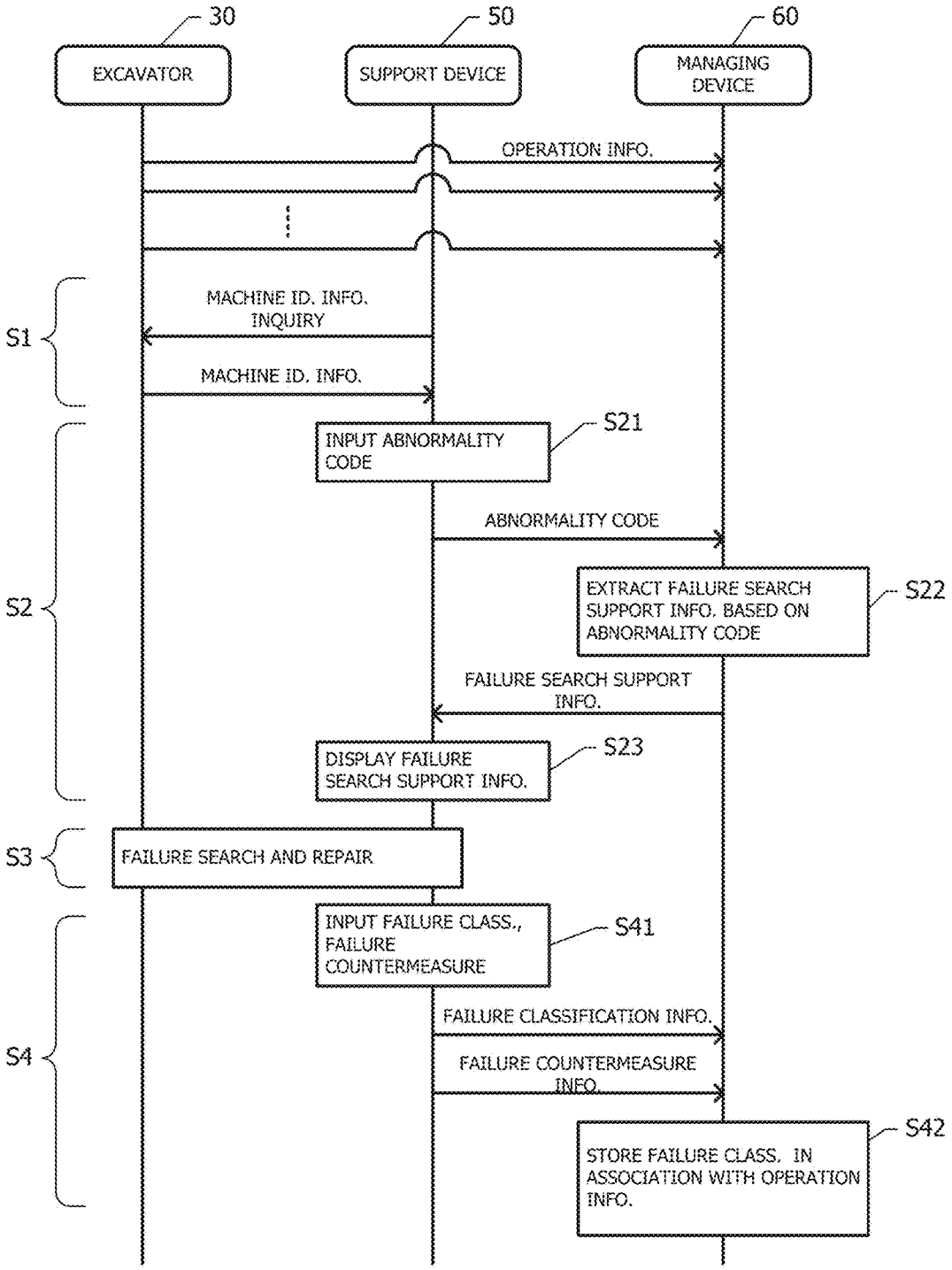
FIG. 7 is a sequence diagram showing a processing sequence of the support device and the managing device for an excavator according to the embodiment.

FIG. 7 shows a processing sequence of the excavator 30, the support device 50, and the excavator managing device 60. The operation information (FIG. 2A) is sent from the excavator 30 to the managing device 60 at regular intervals. The operation information reception processing unit 70 (FIG. 4) of the managing device 60 stores the received operation information in the storage device 65 (FIG. 4).

A step from when an abnormality occurs in the excavator 30 until repair is completed is classified into a machine identification information input step S1, a preparation step S2, a repair step S3, and a post-step S4.

[Machine Identification Information Input Step S1]

Hereinafter, the machine identification information input step S1 will be described. If the serviceman arrives at a site where an excavator in which an abnormality occurs is disposed, and starts the support device 50, an initial screen (FIG. 11A) is displayed on the support device 50. On the initial screen, an excavator type input area 561, a machine number input area 562, a machine number acquisition button 563, and a surrounding search button 564 are displayed.

If the serviceman selects (taps) the machine number acquisition button 563, the machine number inquiry processing unit 88 (FIG. 6) of the support device 50 is started, and as shown in FIG. 7, a machine identification information inquiry command is transmitted to the excavator 30 through the short-range wireless communication device 52 (FIG. 6). After the machine identification information inquiry command is received, the excavator 30 replies the type and machine number (machine identification information) of the excavator 30 to the support device 50.

After the support device 50 receives the machine identification information from the excavator 30, the machine number inquiry processing unit 88 (FIG. 6) displays the received type 565 and machine number 566 on the display device 55 (FIG. 6) and displays buttons for selecting subsequent processing (FIG. 11B). For example, an operation information button 567, a machine history button 568, an alarm button 569, a location information button 570, an abnormality code input button 571, and a failure classification estimation button 572 are displayed on the display device 55.

If the operation information button 567 is tapped, the support device 50 acquires the operation information of the excavator 30 from the managing device 60 and displays the operation information on the display device 55. If the machine history button 568 is tapped, a component replacement history, a repair history, and the like of the excavator 30 are displayed on the display device 55. If the alarm button 569 is tapped, abnormality codes and the like which previously occurred in the excavator 30 are displayed along with date. If the location information button 570 is tapped, a map is displayed on the display device 55, and an icon indicating the current position of the excavator 30 is displayed on the map. If the abnormality code input button 571 and the failure classification estimation button 572 are tapped, the preparation step S2 (FIG. 7) is executed.

Figure 8:
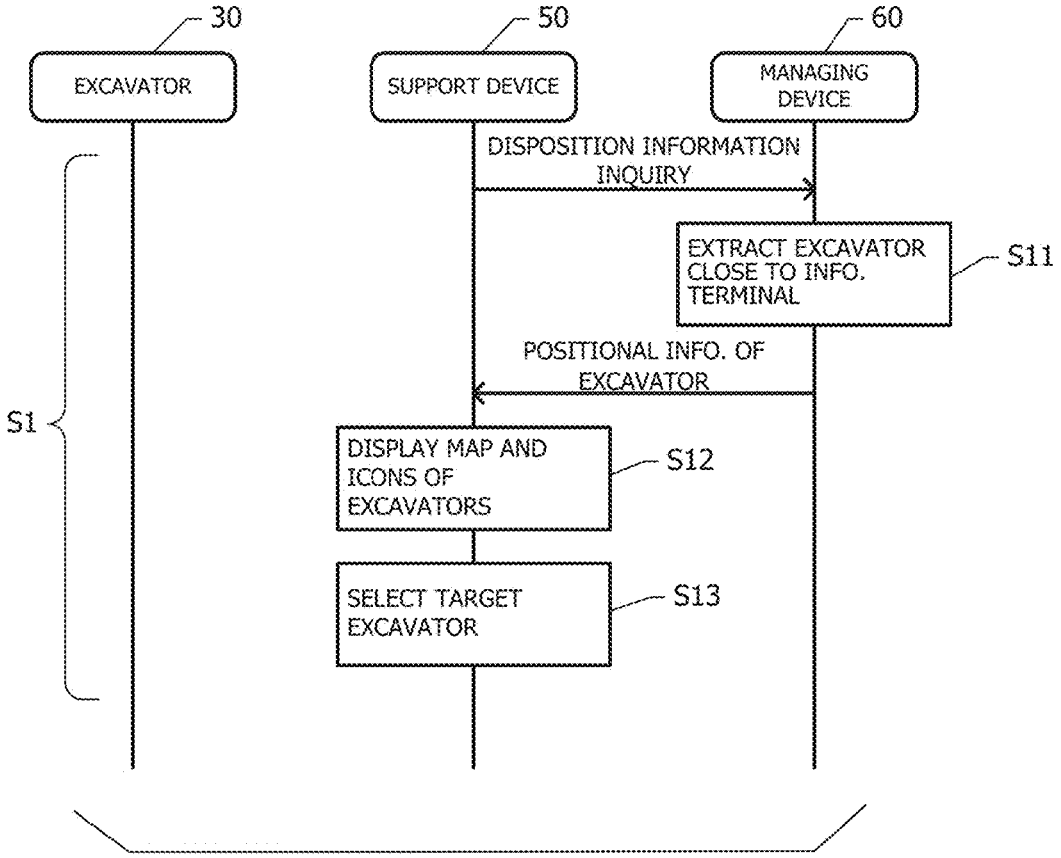
FIG. 8 is a sequence diagram showing a processing sequence of the support device and the managing device for an excavator according to the embodiment.

FIG. 8 shows another processing sequence of the machine identification information input step S1. In this processing sequence, it is not necessary to perform a machine identification information inquiry from the support device 50 shown in FIG. 7 to the excavator 30. In the initial screen shown in FIG. 11A, if the surrounding search button is tapped, the disposition information inquiry processing unit 86 of the support device 50 is started, and a disposition information inquiry command is transmitted to the managing device 60. The disposition information inquiry command includes the current position information of the support device.

After the managing device 60 receives the disposition information inquiry command, the disposition information generation processing unit 75 (FIG. 4) extracts at least one excavator 30 from a plurality of excavators 30 in an order of closeness from the current position of the support device 50 to the current position of the excavator 30 based on the current position information of the support device 50 and the disposition information (FIG. 3C) stored in the storage device 65 (Step S11). The disposition information generation processing unit 75 transmits the current position information of the extracted excavator 30 to the support device 50.

After the support device 50 receives the current position information of the extracted excavator 30, the disposition information inquiry processing unit 86 (FIG. 6) displays excavator selection information on the display device 55 (Step S12), and brings the input device 54 into a state where an input for selecting one excavator is possible. For example, as shown in FIG. 12A, a map is displayed on the display device 55, and the icons of the excavators are displayed on the map. In addition, the types and machine numbers of the excavators disposed in the neighborhood are displayed in a table format. The serviceman taps the icon corresponding to the excavator in which an abnormality occurs, thereby easily selecting the excavator to be repaired (Step S13).

If one excavator is selected, as shown in FIG. 12B, the type and machine number of the selected excavator are displayed on the display device 55. This state is the same as the state shown in FIG. 11B. The serviceman taps the icons corresponding to the excavators other than the excavator to be repaired, thereby confirming the histories (repair histories) or the generation status of the abnormality codes of the excavators being operated in neighboring areas. These repair histories become useful information when repairing the excavator to be repaired.

In a state where the initial screen of the FIG. 11A is displayed, the serviceman may directly input the type and machine number of the target excavator, in which an abnormality occurs, in the excavator type input area and the machine number input area.

[Preparation Step S2]

In the preparation step S2 shown in FIG. 7, if the abnormality code input button 571 (FIG. 11B, FIG. 12B) is tapped, the abnormality code input processing unit 81 (FIG. 6) displays an abnormality code input screen (FIG. 11C) on the display device 55. The abnormality code input screen includes an abnormality code input area 573. In a case where an abnormality occurs in the excavator 30, an abnormality code is displayed on the display device 33 (FIG. 1) of the excavator 30. The serviceman reads this display and inputs the abnormality code in the abnormality code input area 573 (Step S21). The abnormality code generated in the excavator 30 may be transmitted from the excavator 30 to the support device 50 through short-range wireless communication.

After the abnormality code is input, the abnormality code input processing unit 81 (FIG. 6) transmits the input abnormality code to the managing device 60. After the managing device 60 receives the abnormality code, the abnormality code reception processing unit 72 (FIG. 4) extracts corresponding failure search support information (FIGS. 3A to 3C) based on the abnormality code (Step S22). After the failure search support information is extracted, the extracted failure search support information is transmitted to the support device 50.

After the support device 50 receives the failure search support information, the failure search support information reception processing unit 82 (FIG. 6) is started, and the failure search support information is displayed on the display device 55 (Step S23). FIG. 11D shows the support device 50 in a state where failure search support information 574 is displayed. The serviceman can use the failure search support information 574 displayed on the support device 50 as useful information when searching for a failure point.

Figure 9:
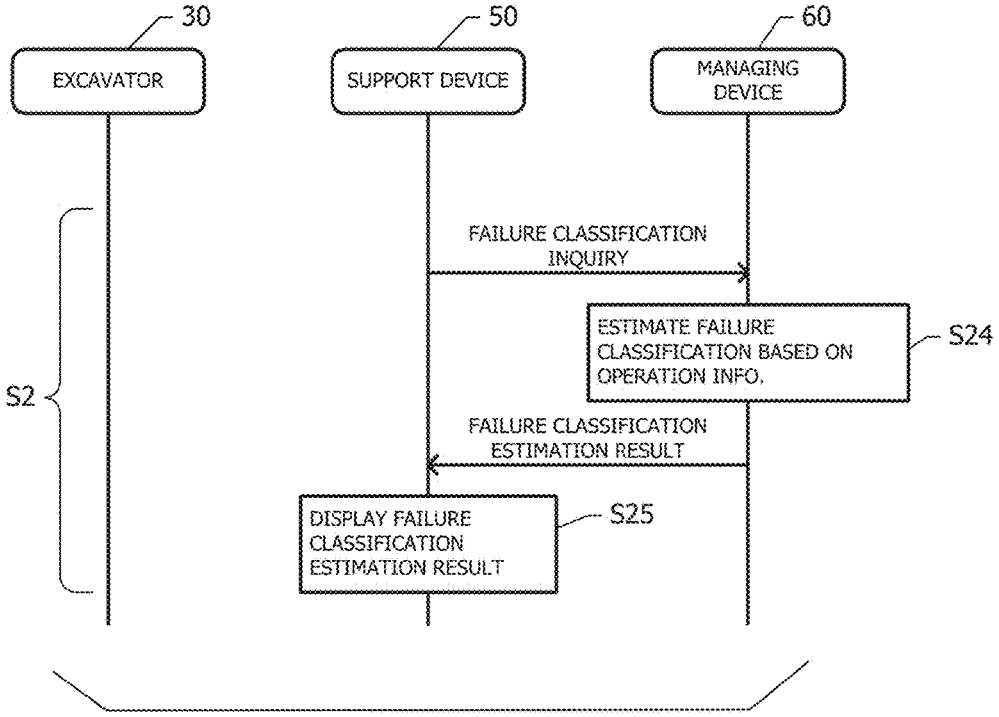
FIG. 9 is a sequence diagram showing a processing sequence of the support device and the managing device for an excavator according to the embodiment.

FIG. 9 shows another processing sequence of the preparation step S2. This processing sequence is executed in a case where any abnormality occurs in the excavator 30, but an abnormality code cannot be specified. In a case where an abnormality code cannot be specified, the serviceman taps the failure classification estimation button (FIG. 11B, FIG. 12B). After the failure classification estimation button is tapped, the failure classification estimation request processing unit 83 of the support device 50 is started, and a failure classification inquiry command is transmitted to the managing device 60. The failure classification inquiry command includes machine identification information and date information.

After the managing device 60 receives the failure classification inquiry command, the failure classification estimation processing unit 73 (FIG. 4) applies the failure classification estimation model 78 (FIG. 5) based on the machine identification information, the date information, and the operation information (FIG. 2A) stored in the storage device 65 and estimates a failure classification occurring in the excavator 30 to be repaired (Step S24). The failure classification estimation processing unit 73 (FIG. 4) transmits an estimation result to the support device 50.

After the support device 50 receives the estimation result of the failure classification, the failure classification reception processing unit 84 is started, and the estimation result of the failure classification is displayed on the display device 55 (Step S25).

Figure 13:
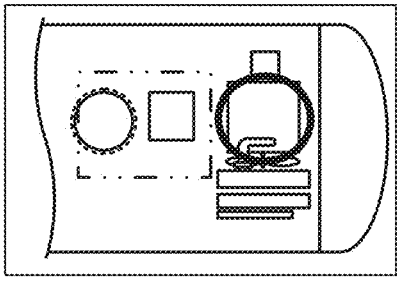
FIG. 13 is a diagram showing a screen of the support device on which a failure classification estimation result is displayed.

FIG. 13 shows the support device 50 on which the estimation result of the failure classification is displayed. The failure classifications allocated with priority are displayed on the display device 55, and a schematic view of the excavator is displayed. In the schematic view of the excavator, the position of a component in which failure is likely to occur is given a mark (for example, circle). The serviceman can use the estimation result of the failure classification displayed on the support device 50 as useful information when searching for a failure point.

[Repair Step S3]

In the repair step S3 shown in FIG. 7, the serviceman performs a failure search with reference to the failure search support information shown in FIG. 11D or the estimation result of the failure classification shown in FIG. 13. After the failure point is specified, repair is performed.

Figure 10:
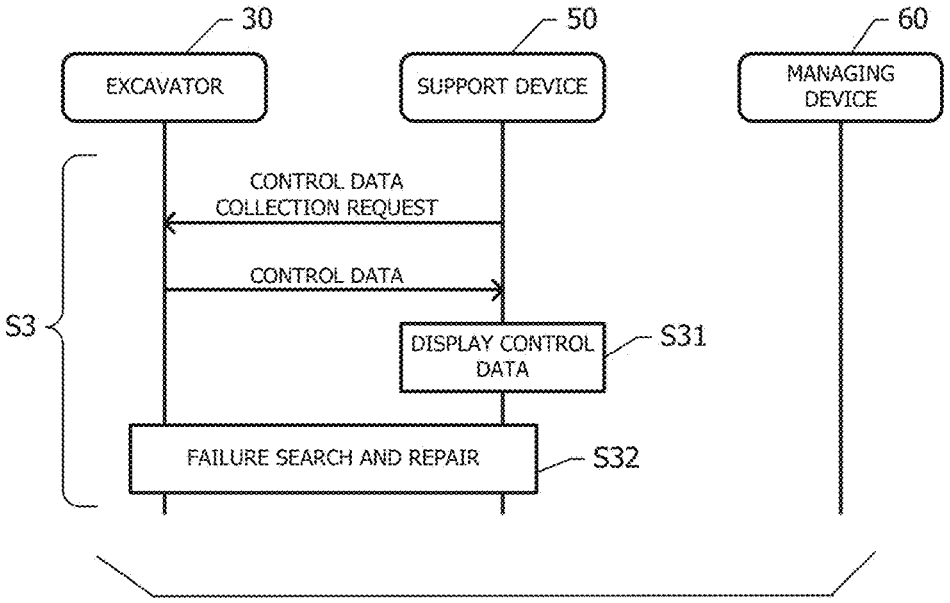
FIG. 10 is a sequence diagram showing a processing sequence of the support device and the managing device for an excavator according to the embodiment.

FIG. 10 shows another processing sequence of the repair step S3. FIG. 14A shows the support device 50 on which the failure search support information is displayed. In FIG. 14A, in addition to the failure search support information displayed on the display device 55 shown in FIG. 11D, a control data collection button is displayed. If the control data collection button is tapped, the control data collection processing unit 87 (FIG. 6) is started, and as shown in FIG. 10, a control data collection request command is transmitted to the excavator 30 to be repaired through the short-range wireless communication device 52 (FIG. 6). After the control data collection request command is received, the excavator 30 replies control data to the support device 50.

Here, "control data" is various kinds of data which are processed by the machine controller 31, the ECU 32 (FIG. 1), and the like of the excavator. "Control data" includes, for example, a swash plate angle of a regulator of a main pump, an ejection pressure of the main pump, a temperature of a hydraulic oil in a storage tank, a pilot pressure for hydraulic control, a measured value of an engine speed, and the like.

The control data is constituted by actual values detected at a constant time interval, and is data before statistical processing is performed.

After the support device 50 receives control data, the control data collection processing unit 87 (FIG. 6) displays temporal change of the control data on the display device 55 (FIG. 6) in a graph (Step S31). FIG. 14B shows the support device 50 on which temporal change of the control data is displayed. The serviceman performs a failure search with reference to a temporal history of the control data, in addition to the failure search support information shown in FIG. 11D or the estimation result of the failure classification shown in FIG. 13 (Step S32).

[Post-Step S4]

Next, the post-step S4 of FIG. 7 will be described. If the failure search and repair are completed, the serviceman operates the support device 50 to display a failure classification input screen (FIG. 11E) on the display device 55. On the failure classification input screen, a failure classification input area 575, a failure countermeasure input area 576, other countermeasures button 577, and a replaced or repaired component name input area 578 are displayed. The serviceman inputs a failure classification found as a result of an actual failure search and an actual failure countermeasure to the support device 50. A typical failure classification or failure countermeasure prepared in advance can be selected and input from a pull-down menu. In a case where the corresponding failure classification or failure countermeasure is not displayed in the pull-down menu, the serviceman can input an arbitrary sentence by tapping the other countermeasures button 577.

In the component name input area 578, a component name is displayed corresponding to the contents of the selected failure classification and failure countermeasure. In addition, the number of pieces input field is displayed in relation to the component name. The serviceman may select an actually replaced or repaired component name from the component names displayed in the component name input area 578. The serviceman inputs the number of pieces of the replaced or repaired component in relation to the selected component name. In the component name input area 578, the component name in relation to the failure classification and the failure countermeasure is displayed, whereby it is possible to save the effort to input the component name.

As shown in FIG. 11F, in the component name input area 578, a field in which a region and a component type are input in relation to the component name may be provided. The "region" indicates a place where a corresponding component is incorporated. The "region" includes, for example, an engine, a boom top, a boom bottom, a hydraulic main pump, and the like.

For a case where a repaired or replaced component name is not displayed, a component search function may be provided. A component search field 579 may be displayed. The component search field 579 is displayed on the display device 55. If the serviceman inputs a component name or a part of the component name in the component search field 579, the input component name is displayed in the component name input area 578.

After the failure classification and the failure countermeasure are input (Step S41), the failure classification input processing unit 80 (FIG. 6) of the support device 50 transmits the machine number of the excavator, the failure classification information, the failure countermeasure information, and repair/replacement component information to the managing device 60. After the managing device 60 receives the machine number of the excavator, the failure classification information, the failure countermeasure information, and the repair/replacement component information, the failure classification reception processing unit 71 (FIG. 4) stores the failure classification information and the operation information in the storage device 65 related to each other (Step S42). The failure classification information and the operation information can be related to each other based on the items of the machine identification information (FIG. 2A, FIG. 3A) and the date (FIG. 2A, FIG. 3A).

The managing device 60 has a repair/replacement component database for each excavator machine. After the repair/replacement component information is received from the support device 50, the managing device 60 updates the repair/replacement component database of the excavator of the received machine number. With this, it is possible to keep the repair/replacement component database of the service target excavator up to date.

The failure classification estimation processing unit 73 (FIG. 4) of the managing device 60 can use the failure classification information and the failure countermeasure information related to the operation information when estimating the failure classification based on the operation information. For example, the causal relationship between the operation information and the failure classification is modeled and included in a data mining method, whereby it is possible to increase the estimation accuracy of the failure classification. In this way, the failure classification information and the operation information newly stored in the storage device 65 can be used for estimating the subsequent failure classification. The usable failure classification information and operation information are increased, whereby it is possible to increase the estimation accuracy of the failure classification when transmitting the estimation result of the failure classification to the support device 50.

For example, in a case where the estimated failure classification information (FIG. 5) transmitted from the managing device 60 to the support device 50 and the actual failure classification found as a result of the failure search do not match each other, it is possible to correct the failure classification estimation model 78 (FIG. 5) based on the actual failure classification.

In addition, it is possible to correct the failure search support information (FIGS. 3A to 3C) to more proper failure search support information based on the abnormality code generated in the excavator 30, the failure classification information, and the failure countermeasure information.

In the foregoing embodiment, the serviceman performs the failure search and repair (the repair step S3 of FIG. 7) and then operates the support device 50, whereby the failure classification input screen (FIG. 11E) is displayed on the support device 50. In Step S23 (FIG. 7), information for prompting the input of the failure classification may be displayed on the display device 55 (FIG. 6) of the support device 50 along with the failure search support information (FIG. 11D). Alternatively, after the display of the failure search support information (FIG. 11D) ends, the failure classification input screen (FIG. 11E) may be displayed. In this way, the support device 50 displays information for prompting the input of the failure classification, whereby it is possible to prevent forgetting of the input of the failure classification after the failure search and repair.

Next, another embodiment will be described referring to FIGS. 15 to 18. Hereinafter, a difference from the embodiment shown in FIGS. 1 to 14A and 14B will be described, and description of the common configuration will not be repeated. In the foregoing embodiment, as described referring to FIG. 7, the operation information (FIG. 2A) is sent from the excavator 30 to the managing device 60 at regular intervals. In the following embodiment, the frequency at which the operation information is sent is changed depending on the state of the excavator 30.

Figure 15:
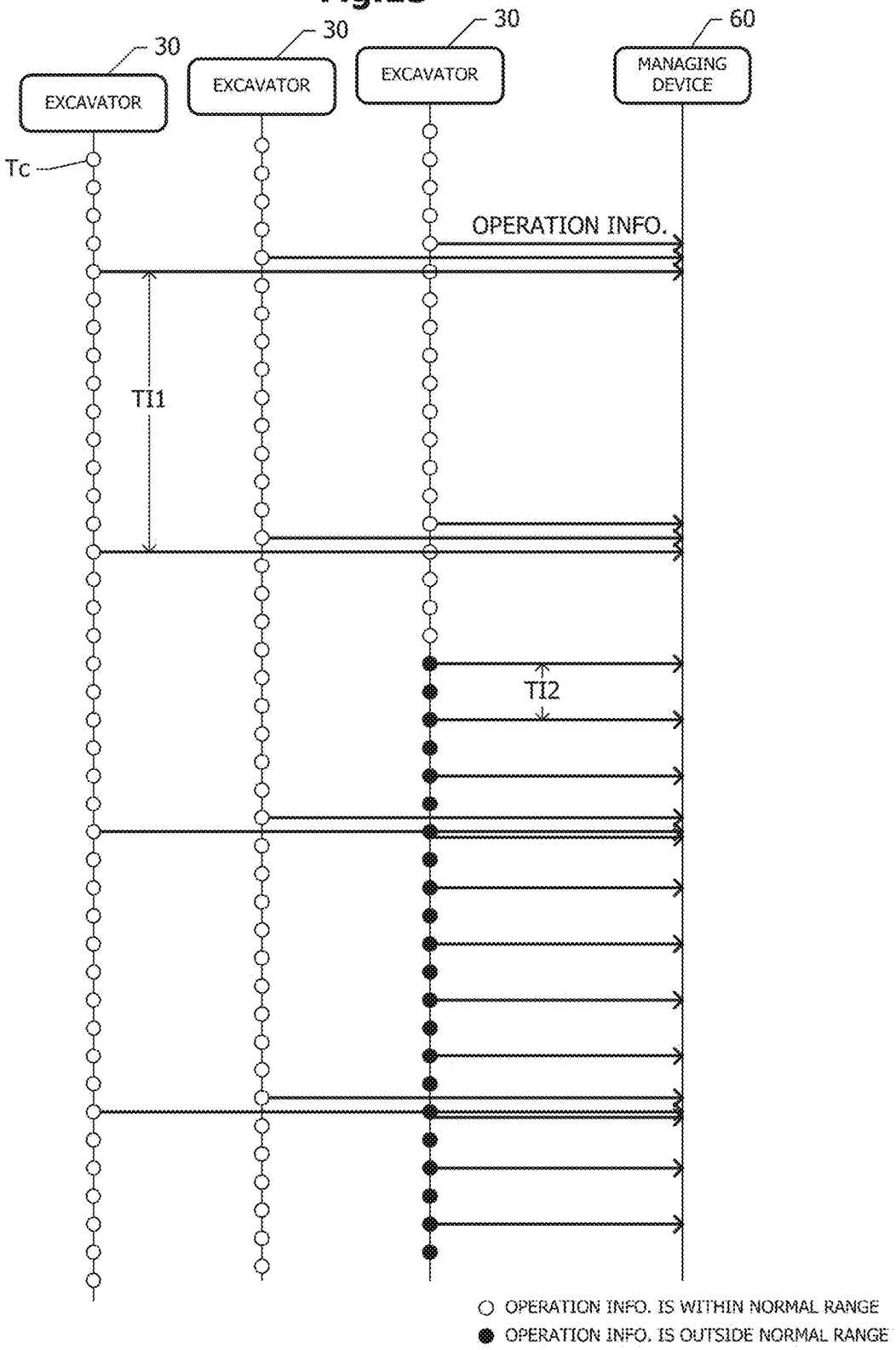
FIG. 15 is a sequence diagram showing an example of a transmission sequence when operation information is transmitted from a plurality of excavators to the managing device.

FIG. 15 shows an example of a transmission sequence when the operation information is transmitted from a plurality of excavators 30 to the managing device 60. Each of the excavators 30 collects the operation information at a given time interval. In FIG. 15, a collection time Tc of the operation information is represented by a hollow or solid circle symbol. After the operation information is collected, each of the excavators 30 determines whether or not the collected operation information is within a normal range. The collection time Tc when it is determined that the operation information is within the normal range is represented by the hollow circle symbol, and the collection time Tc when it is determined that the operation information is outside the normal range is represented by the solid circle symbol.

In a period during which it is determined that the operation information is within the normal range, each of the excavators 30 transmits the operation information to the managing device 60 at a first time interval TI1. If it is determined that the operation information is outside the normal range, each of the excavators 30 increases the frequency of transmitting the operation information. For example, if it is determined that the operation information is outside the normal range, the operation information is transmitted to the managing device 60 at a second time interval TI2 shorter than the first time interval TI1. If the operation information is returned within the normal range, the transmission frequency of the operation information returns to the original state.

Figure 16:
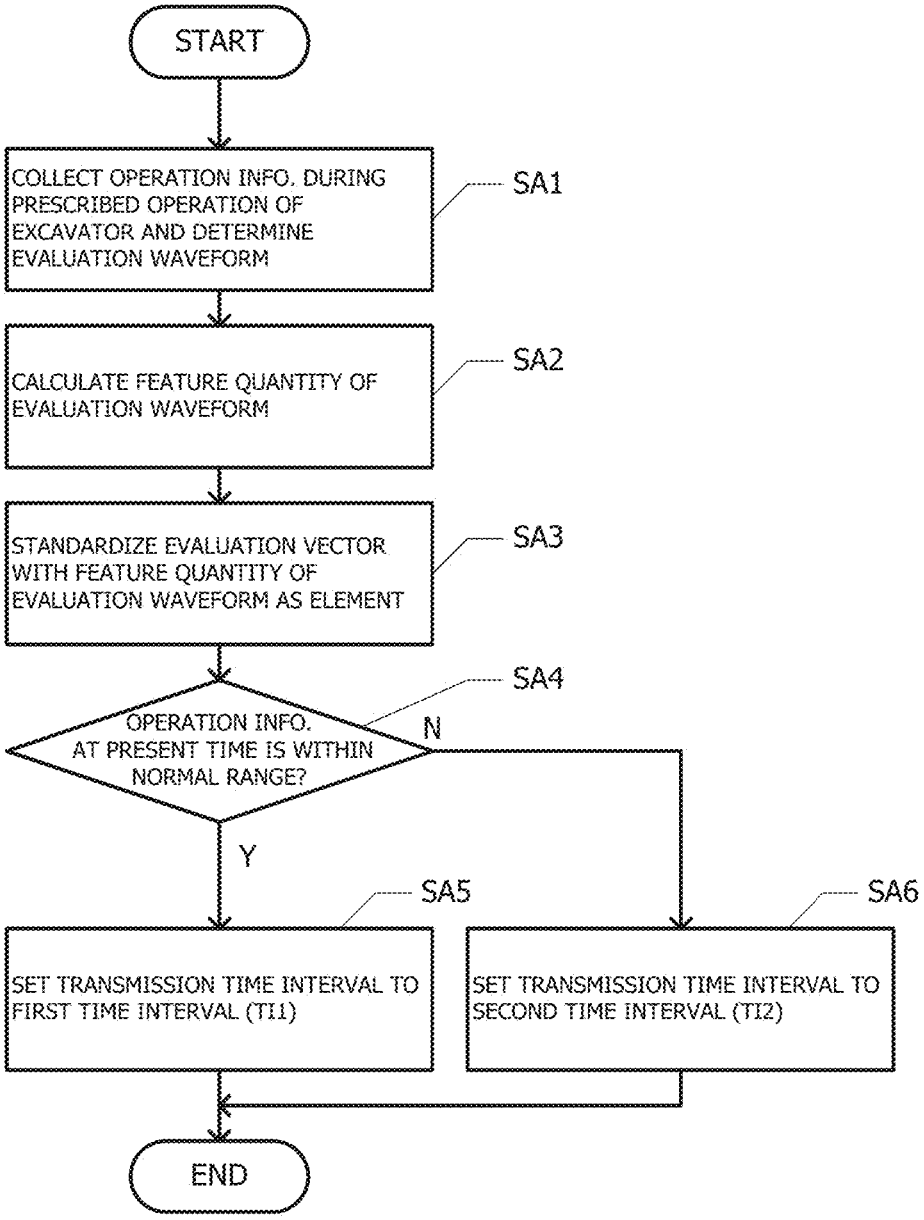
FIG. 16 is a flowchart of a processing which is executed by an excavator.

FIG. 16 shows a flowchart of processing which is executed by the excavator 30. This processing is executed by, for example, the machine controller 31 (FIG. 1) of the excavator 30. In Step SA1, in a period during which the excavator 30 performs a prescribed operation, the operating variable of the excavator 30 is acquired at a given time interval. The prescribed operation means one operation selected from various operations when the excavator 30 is operated. As an example of the prescribed operation, an idling operation, a hydraulic relief operation, a boom lifting operation, a boom lowering operation, a turning operation, an advance operation, a retreat operation, and the like are considered. As an operating variable, for example, the engine speed is used. Temporal change of the operating variable acquired by the excavator 30 is referred to as an evaluation waveform.

In Step SA2, a feature quantity is calculated from the evaluation waveform. The "feature quantity" means various statistics for distinguishing the shape of the waveform. For example, as the feature quantity, an average value, a standard deviation, a maximum wave height value, the number of peaks, a maximum value of a signal non-existence time, and the like can be used.

Figure 17:
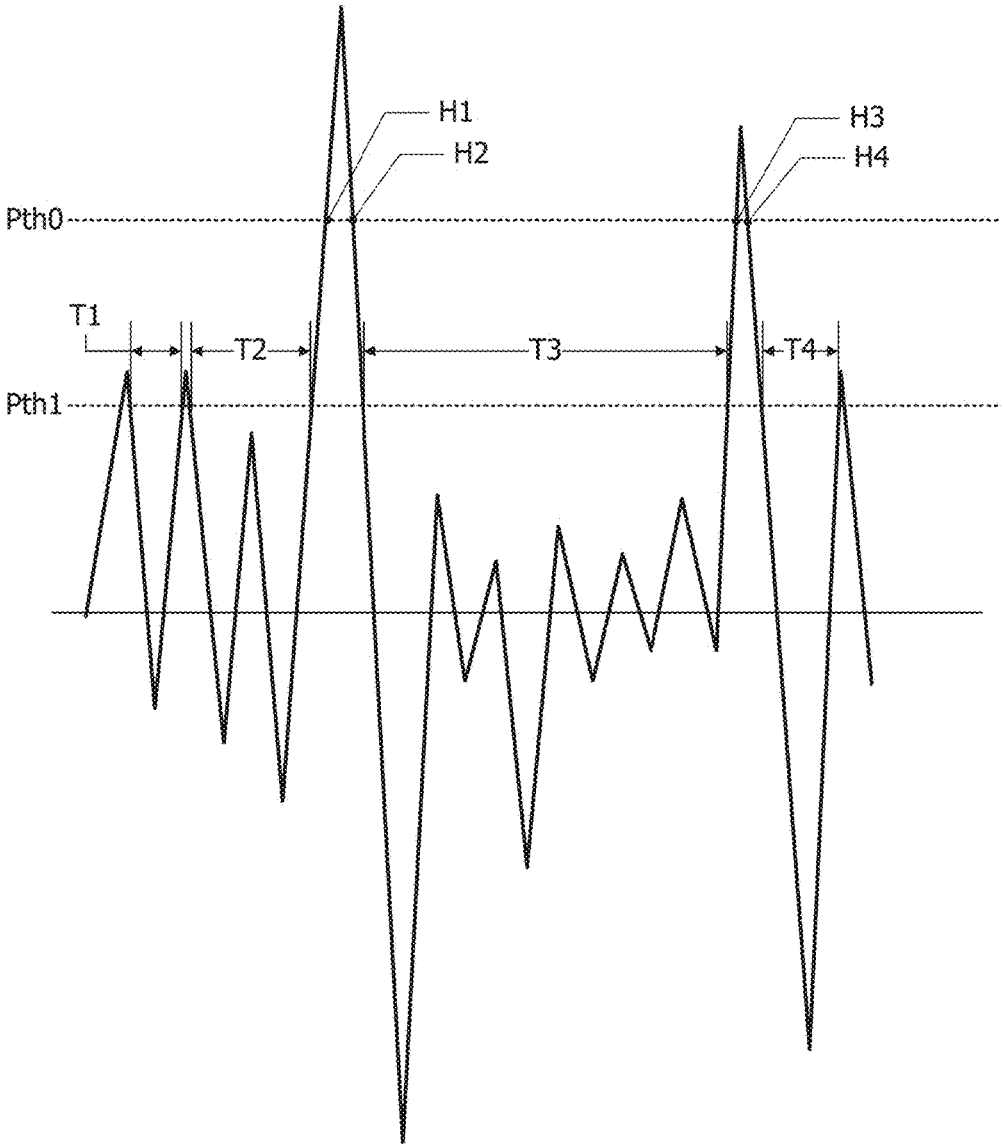
FIG. 17 is a graph illustrating a part of an evaluation waveform.

The number of peaks and the maximum value of the signal non-existence time will be described referring to FIG. 17. FIG. 17 illustrates a portion of the evaluation waveform. The "number of peaks" is defined by, for example, the number of places where the waveform crosses a threshold Pth0. In the period shown in FIG. 17, the waveform crosses the threshold Pth0 at intersection points H1 to H4. For this reason, the number of peaks is calculated to be 4.

A section in which the waveform is lower than a threshold Pth1 is defined as a signal non-existence section. In the example shown in FIG. 17, signal non-existence sections T1 to T4 appear. The maximum value of the signal non-existence time means a maximum time width among a plurality of time widths of the signal non-existence section. In the example shown in FIG. 17, the time width of the signal non-existence section T3 is used as the maximum value of the signal non-existence time. In general, if there is long cycle waviness in the waveform, the maximum value of the signal non-existence time is increased.

In Step SA3 (FIG. 16), an evaluation vector with the feature quantity of the evaluation waveform as an element is standardized to determine a standardized evaluation vector. Hereinafter, a procedure for standardizing an evaluation vector will be described.

The operating variables when the excavator 30 performs the prescribed operation in the normal state are collected in advance. A plurality of time waveforms are cut from the operating variables collected over a certain period. The time waveforms are referred to as reference waveforms. For each of a plurality of reference waveforms, a feature quantity is calculated. A reference vector with the feature quantity of each of a plurality of reference waveforms as an element is obtained. Each feature quantity of the reference vector is standardized such that the average becomes 0 and the standard deviation becomes 1, thereby determining the standardized reference vector. In this standardization processing, the average value and the standard deviation of each feature quantity of a plurality of reference vectors are used. An average value of a feature quantity i is represented as m(i), and a standard deviation is represented as σ(i).

The evaluation vector is standardized using the average value m(i) and the standard deviation σ(i) of the feature quantity i of the reference vector. When the feature quantity i of the evaluation vector is represented as σ(i), the feature quantity i of the standardized evaluation vector is represented as $(a(i)-m(i))/\sigma(i)$. In a case where the shape of the evaluation waveform is close to the shape of the reference waveform, each feature quantity i of the standardized evaluation vector becomes close to 0, and in a case where the difference between the shape of the evaluation waveform and the shape of the reference waveform is large, the absolute value of the feature quantity i of the standardized evaluation vector becomes large.

Figure 18:
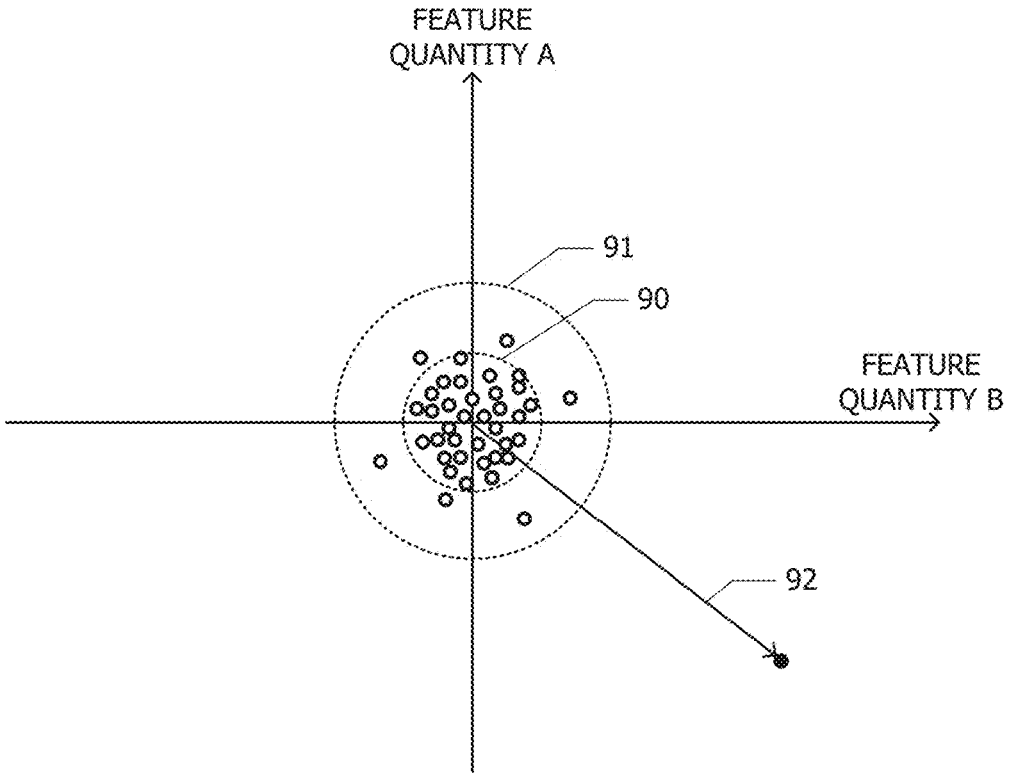
FIG. 18 is a graph showing an example of a distribution of standardized reference vectors and a standardized evaluation vector.

FIG. 18 shows an example of the distribution of standardized reference vectors and a standardized evaluation vector 92. In FIG. 18, while the distribution of the standardized reference vectors is shown in a two-dimensional plane for two feature quantity A and feature quantity B, actually, the standardized reference vectors and the standardized evaluation vector are distributed in a vector space having a dimension according to the number of feature quantities i. An end point of the standardized reference vector is represented by a hollow circle symbol. About 68% of the standardized reference vectors are distributed within a sphere 90 having a radius of 1σ. Here, σ represents a standard deviation, and since each feature quantity is standardized, the standard deviation σ equals 1.

In Step SA4 (FIG. 16), it is determined whether the operation information at the present time is within the normal range or outside the normal range. Diagnosis regarding whether or not the operation information is within the normal range is performed based on the length of the standardized evaluation vector 92 (FIG. 18) determined from the operation information. In a case where the length of the standardized evaluation vector 92 is equal to or less than a normal determination threshold, it is determined that the operation information is within the normal range. In a case where the length of the standardized evaluation vector exceeds the normal determination threshold, it is determined that the operation information is outside the normal range.

As the normal determination threshold, for example, 2σ is selected. In the vector space shown in FIG. 18, when the endpoint of the standardized evaluation vector 92 is positioned within a sphere 91 having a radius of 2σ, it is determined that the operation information is within the normal range. When the endpoint of the standardized evaluation vector 92 is positioned outside the sphere 91 having a radius of 2σ, it is determined that the operation information is outside the normal range.

When the operation information at the present time is within the normal range, in Step SA5 (FIG. 16), the transmission time interval of the operation information is set to the first time interval TI1. When the operation information at the present time is outside the normal range, in Step SA6 (FIG. 16), the transmission time interval of the operation information is set to the second time interval TI2 shorter than the first time interval TI1.

Next, advantageous effects of the embodiment shown in FIGS. 15 to 18 will be described. In Step S42 (FIG. 7), in order to make the relation of the failure classification and the operation information more proper, it is preferable to increase the collection frequency of the operation information. Meanwhile, if the collection frequency increases, data communication cost increases.

In the foregoing embodiment, when the operation information is outside the normal range, the transmission frequency of the operation information increases compared to a period during which the operation information is within the normal range. For this reason, it is possible to make the relation of the failure classification and the operation information more proper. Since the transmission frequency of the operation information is lowered in a period during which the operation information is within the normal range, it is possible to suppress data communication cost. In a case where the operation information is within the normal range, the operation information is not related to the failure classification. Accordingly, even if the transmission frequency of the operation information is lowered, it is not disturbed to make the relation of the failure classification and the operation information proper.

Next, another embodiment will be described referring to FIGS. 19 and 20. Hereinafter, a difference from the embodiment shown in FIGS. 1 to 14A and 14B will be described, and description of the common configuration will not be repeated.

Figure 19:
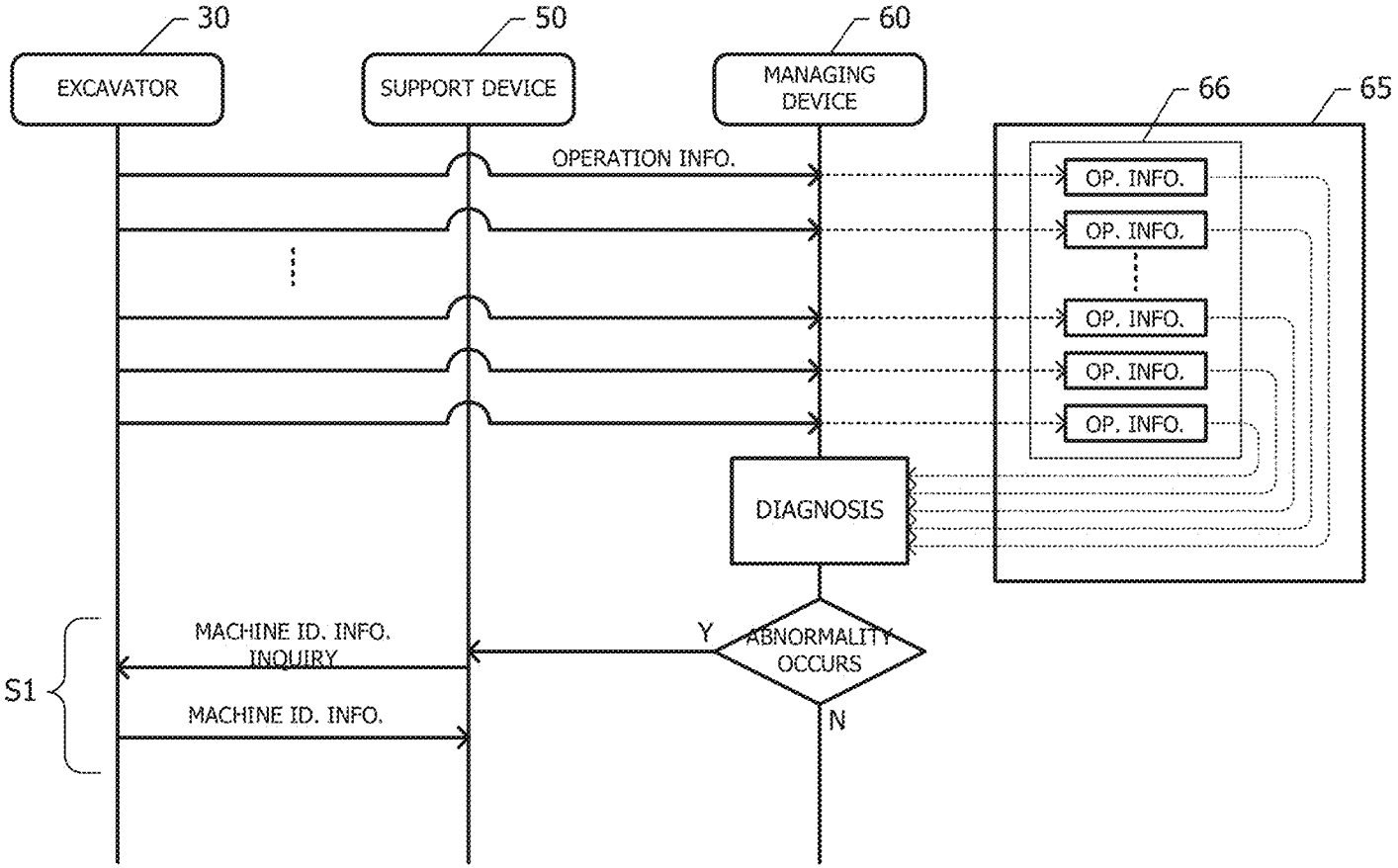
FIG. 19 is a sequence diagram showing a processing sequence of the excavator, the support device, and the excavator managing device.

FIG. 19 shows a processing sequence of the excavator 30, the support device 50, and the excavator managing device 60. The operation information (FIG. 2A) is sent from the excavator 30 to the managing device 60 under transmission conditions set in advance. The transmission conditions include, for example, a condition that transmission is performed in a given transmission cycle as shown in FIG. 15 and a condition that an abnormality is detected in the excavator 30. The operation information reception processing unit 70 (FIG. 4) of the managing device 60 stores the received operation information in an operation information storage area 66 of the storage device 65. In the operation information storage area 66, the recently acquired operation information and a plurality of pieces of previously acquired operation information are stored with respect to one excavator 30.

Here, the "recently acquired operation information" means the latest operation information among the operation information transmitted under the transmission conditions set in advance. The "previously acquired operation information" means the operation information other than the latest operation information among the operation information transmitted under the transmission conditions set in advance.

The processing device 61 (FIG. 4) of the managing device 60 performs diagnosis regarding whether or not the excavator 30 is normal based on the recently acquired operation information and a plurality of pieces of previously acquired operation information. Hereinafter, a diagnosis method which is executed by the processing device 61 will be described. The managing device 60 determines the standardized evaluation vector for each of the recently acquired operation information and the previously acquired operation information. A method of determining the standardized evaluation vector is the same as the method of Steps SA1 to SA3 of FIG. 16.

Figure 20:
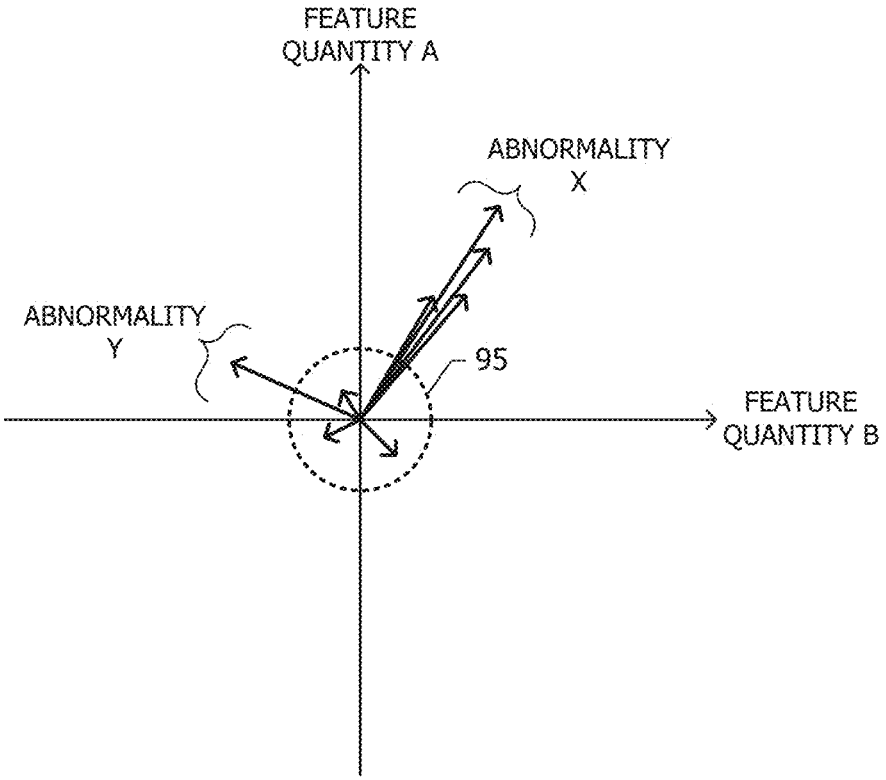
FIG. 20 is a graph showing an example of a standardized evaluation vector determined for each of a plurality of pieces of operation information.

FIG. 20 shows an example of the standardized evaluation vector determined for each of a plurality of pieces of operation information. Apart of the standardized evaluation vectors are included in a normal range 95, and other standardized evaluation vectors are extended outside the normal range 95. Here, as the normal range 95, for example, a sphere having a radius of 3σ is used. An area outside the normal range 95 as the sphere having a radius of 3σ means that the value of any feature quantity is separated from the average value of the feature quantity at normal time by three or more times the standard deviation.

The standardized evaluation vector extended outside the normal range 95 suggests that any abnormality occurs in the excavator 30. It is considered that the time waveform of the operating variable depends on the classification of an abnormality occurring in the excavator 30. For this reason, it can be considered that the classification of the abnormality occurring in the excavator 30 is reflected in the direction of the standardized evaluation vector.

The processing device 61 (FIG. 4) determines whether or not the operation information is within the normal range for each piece of operation information based on the length and direction of the standardized evaluation vector. With this, a determination result is obtained for each piece of operation information. The processing device 61 performs diagnosis of the excavator 30 based on a plurality of obtained determination results.

In this embodiment, a diagnosis result of the excavator 30 is obtained from a plurality of determination results by majority decision. In the example shown in FIG. 20, three standardized evaluation vectors suggest normality, four standardized evaluation vectors among a plurality of standardized evaluation vectors outside the normal range 95 suggest an abnormality X, and one standardized evaluation vector suggests an abnormality Y. In this case, it is determined that the abnormality X occurs in the excavator 30 by majority decision.

As shown in FIG. 19, in a case where it is determined that the abnormality X occurs in the excavator 30 as a result of diagnosis, the managing device 60 gives notification of the abnormality X occurring to the support device 50 along with the machine identification information of the excavator 30. After this notification is received, the support device 50 displays an abnormality occurring in the excavator 30 on the display device 55 (FIG. 6) along with the machine identification information. With this, the serviceman can quickly perform the failure search and repair of the excavator 30 in which an abnormality occurs.

Majority decision with weight may be used when performing diagnosis of normality from a plurality of standardized evaluation vectors by majority decision. It is considered that the present status of the excavator 30 is more accurately reflected in the recently acquired operation information than in the previously acquired operation information. Accordingly, it is preferable that, the more recent the standardized evaluation vector of the operation information is obtained, the larger the weighting factor is made.

Instead of majority decision or majority decision with weight, determination of normality may be performed based on an average vector of a plurality of standardized evaluation vectors.

Next, advantageous effects of the embodiment shown in FIGS. 19 and 20 will be described. The time waveform of the operating variable may be disturbed due to a special situation, such as temporal environmental change. If diagnosis of the excavator 30 is performed based on the standardized evaluation vector generated from the temporally disturbed time waveform, reliability of the diagnosis result is degraded. In the embodiment shown in FIGS. 19 and 20, diagnosis of the excavator 30 is performed with not only the recently acquired operation information but also the previously acquired operation information. For this reason, it is possible to exclude the influence of the special situation, such as temporal environmental change, and to increase reliability of diagnosis.

It is preferable to secure the number of samples sufficient for increasing accuracy of diagnosis. In order to secure a sufficient number of samples, the operation information acquired one day or more ago may be used as the "previously acquired operation information". With this, the diagnosis result is hardly affected by daily environmental change. In a case of determining the diagnosis result of the excavator 30 by majority decision, the recently acquired operation information and at least two pieces of previously acquired operation information are used as operation information to be a basis for diagnosis.

Although the invention has been described in connection with the embodiments, the invention is not limited to these examples. For example, it is obvious to those skilled in the art that various alterations, improvements, combinations, and the like can be made.

What is claimed is:

1. An excavator managing device including a network computer comprising:

a transmitter;

a receiver;

a storage; and a processor, wherein the processor receives machine identification information of an excavator and operation information representing the operation status of the excavator from the excavator through the receiver, receives machine identification information of the excavator and failure classification information of the excavator from a mobile tablet through the receiver, and stores the failure classification information and the operation information in the storage in association with each other based on the machine identification information.

2. The excavator managing device according to claim 1, wherein the storage stores a plurality of abnormality codes indicating abnormality occurring in the excavator in association with a plurality of pieces of failure search support information, and after the processor receives the abnormality code from the mobile tablet the processor extracts at least one piece of failure search support information from the plurality of pieces of failure search support information based on the received abnormality code and transmits the extracted failure search support information to the mobile tablet.

3. The excavator managing device according to claim 1, wherein the processor has a function of estimating a failure classification occurring in the excavator based on the operation information of the excavator, after the processor receives the machine identification information of the excavator and a command to inquire a failure classification from the mobile tablet through the receiver, estimates a failure classification based on the operation information received from a machine corresponding to the received machine identification information, and transmits the estimated failure classification to the mobile tablet.

4. The excavator managing device according to claim 1, wherein the processor receives failure countermeasure information indicating an actually performed failure countermeasure from the mobile tablet and stores the failure countermeasure information in the storage in association with the failure classification information and the operation information.

5. The excavator managing device according to claim 1, wherein the processor stores current position information received from a plurality of excavators in the storage, after the processor receives the current position information of the mobile tablet from the mobile tablet, extracts at least one excavator from the plurality of excavators in an order of closeness from the current position of the mobile tablet to the current position of the excavator and transmits the current position information of the extracted excavator to the mobile tablet.

6. The excavator managing device according to claim 1, wherein the excavator has a function of diagnosing whether the operation information of the excavator is within a normal range or outside the normal range, and in a case where the operation information is within the normal range, the processor receives the operation information at a frequency less than in a case where the operation information is outside the normal range.

7. The excavator managing device according to claim 1, wherein the operation information includes a value calculated based on a time waveform of an operating variable obtained by measuring a plurality of operating variables depending on the operation status of the excavator, and the processor determines whether or not the excavator is normal based on the recently acquired operation information and the previously acquired operation information among a plurality of pieces of operation information acquired from the same excavator.

8. The excavator managing device according to claim 7, wherein the processor determines whether or not the operation information is within a normal range for each of the plurality of pieces of operation information and determines whether or not the excavator is normal based on a plurality of determination results.

9. The excavator managing device according to claim 1, wherein the processor receives the machine identification information of the excavator and the failure classification information of the excavator directly from the mobile tablet.

10. The excavator managing device according to claim 1, wherein the processor receives the failure classification information of the excavator from the mobile tablet that is configured to receive, from a user of the mobile tablet, the failure classification information including a selection of service among exchanges and repairs displayed in a touch screen of the mobile tablet.

11. A mobile tablet comprising:

a touch screen;

a transmitter;

a receiver; and a processor, wherein, after a failure classification occurring in an excavator is input from the touch screen, the processor transmits the failure classification and machine identification information to a network computer through the transmitter, the network computer being configured to store operation information and the failure classification that are provided by the excavator in association with each other based on the machine identification information.

12. The mobile tablet according to claim 11, wherein, after failure countermeasure information indicating an actually performed failure countermeasure is input from the touch screen, the processor transmits the input failure countermeasure information to the network computer through the transmitter.

13. The mobile tablet according to claim 11, wherein, after the processor receives failure search support information for specifying a failure classification of the excavator from the network computer through the receiver, the processor displays the received failure search support information on the touch screen.

14. The mobile tablet according to claim 13, wherein, after the processor receives current position information of an excavator disposed closely from the network computer through the receiver, the processor displays excavator selection information for specifying the received excavator on the touch panel and brings the touch screen into a state where an input for selecting one excavator based on the displayed excavator selection information is enabled.

15. A mobile tablet comprising:

a touch screen;

a display;

a transmitter;

a receiver; and a processor, wherein the processor performs display for prompting an input of a failure classification occurring in an excavator on the display and after the failure classification and machine identification information are is input through the display, performs processing based on the input failure classification.

16. The mobile tablet according to claim 15, wherein the processor transmits the input failure classification to a network computer through the transmitter.

* * * * *